US011583062B2

(12) United States Patent
Berhault et al.

(10) Patent No.: US 11,583,062 B2
(45) Date of Patent: Feb. 21, 2023

(54) BRUSH FOR APPLYING A PRODUCT TO THE EYELASHES AND/OR EYEBROWS

(71) Applicant: L'OREAL, Paris (FR)

(72) Inventors: Alain Berhault, Clichy (FR); Audrey Thenin, Clichy (FR)

(73) Assignee: L'OREAL, Paris (FR)

( * ) Notice: Subject to any disclaimer, the term of this patent is extended or adjusted under 35 U.S.C. 154(b) by 381 days.

(21) Appl. No.: 15/567,516

(22) PCT Filed: Apr. 15, 2016

(86) PCT No.: PCT/EP2016/058445
§ 371 (c)(1),
(2) Date: Oct. 18, 2017

(87) PCT Pub. No.: WO2016/169863
PCT Pub. Date: Oct. 27, 2016

(65) Prior Publication Data

US 2018/0110320 A1 Apr. 26, 2018

(30) Foreign Application Priority Data

Apr. 21, 2015 (FR) ..... 1553554

(51) Int. Cl.
*A46B 9/02* (2006.01)
*A46B 3/18* (2006.01)
(Continued)

(52) U.S. Cl.
CPC ..... *A46B 9/028* (2013.01); *A45D 40/267* (2013.01); *A46B 3/18* (2013.01); *A46B 9/021* (2013.01);
(Continued)

(58) Field of Classification Search
CPC .. A45D 40/262; A45D 40/265; A45D 40/267; A45D 40/26; A45D 40/28; A46B 9/021; A46B 2210/1053; A46B 2210/106
See application file for complete search history.

(56) References Cited

U.S. PATENT DOCUMENTS 1,659,707 A * 2/1928 Lucia ..... A45D 40/26 15/206
5,482,059 A * 1/1996 Miraglia ..... A46B 3/18 15/207.2
(Continued)

FOREIGN PATENT DOCUMENTS

EP 0 832 580 A1 4/1998
EP 0 842 620 A1 5/1998
(Continued)

OTHER PUBLICATIONS

International Search Report for PCT/EP2016/058445 dated Aug. 16, 2016 (2 pages).
(Continued)

*Primary Examiner* — Cris L. Rodriguez
*Assistant Examiner* — Brianne E Kalach
(74) *Attorney, Agent, or Firm* — Shumaker, Loop & Kendrick, LLP

(57) ABSTRACT

The present invention relates to a brush (10) for applying a product (P) to the eyelashes and/or eyebrows, comprising: a core (40), notably a twisted core, extending along a longitudinal axis (X), comprising a portion of the core carrying the bristles that has a proximal end intended to be fixed to a stem and a distal end, the portion of the core carrying the bristles having a rectilinear proximal portion that extends along more than half of its length from the proximal end of the portion of the core carrying the bristles, and having at least one bend made at the distal end of the portion of the core carrying the bristles, and bristles (41) held by the core
(Continued)

Figure 1:
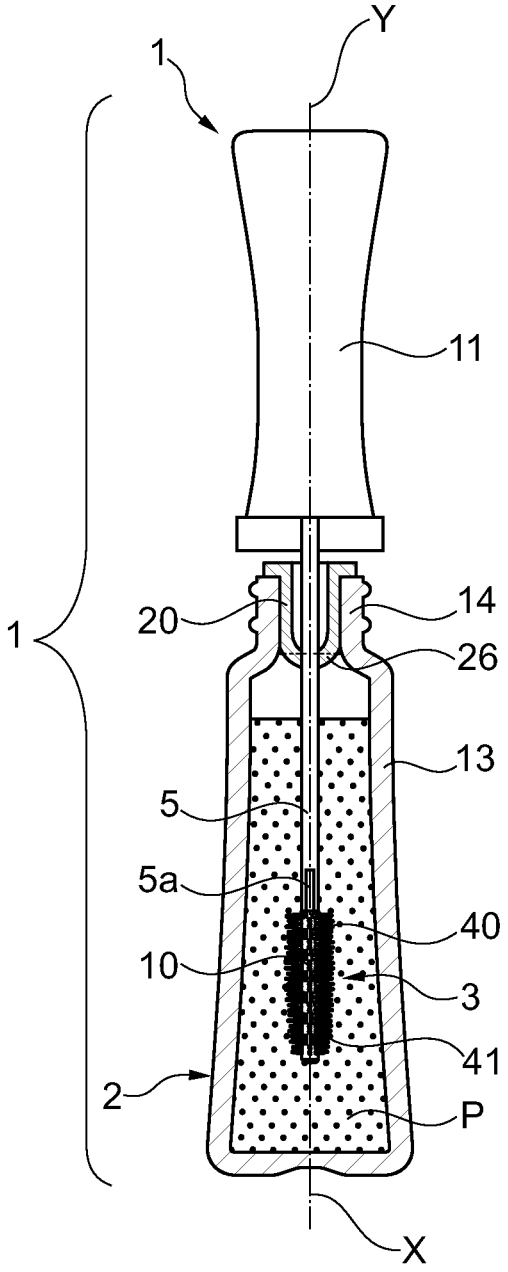

(40), the bristles (41) having free ends that define an envelope surface, the envelope surface having at least one longitudinally extending cutout.

21 Claims, 7 Drawing Sheets

(51) Int. Cl.
*A45D 40/26* (2006.01)
*A46D 3/00* (2006.01)
*A46B 5/00* (2006.01)

(52) U.S. Cl.
CPC ..... *A46D 3/00* (2013.01); *A46B 5/0079* (2013.01); *A46B 2200/1053* (2013.01)

(56) References Cited

U.S. PATENT DOCUMENTS

| | | | | |
|---|---|---|---|---|
| 5,542,439 | A * | 8/1996 | Gueret | A46B 3/18 132/218 |
| 2002/0124860 | A1* | 9/2002 | Gueret | A46B 3/18 132/218 |
| 2002/0124861 | A1* | 9/2002 | Gueret | A46B 3/18 132/218 |
| 2002/0139385 | A1* | 10/2002 | Gueret | A46B 3/18 132/218 |
| 2008/0083421 | A1* | 4/2008 | Malvar | A46D 1/00 132/218 |
| 2009/0199862 | A1 | 8/2009 | Gueret | |
| 2010/0003065 | A1* | 1/2010 | Haan | A45D 40/265 401/124 |
| 2011/0129286 | A1* | 6/2011 | Gueret | A45D 40/267 401/122 |

FOREIGN PATENT DOCUMENTS

| | | | |
|---|---|---|---|
| EP | 1 236 419 | A1 | 9/2002 |
| EP | 1 236 420 | A1 | 9/2002 |
| EP | 1236421 | A1 | 9/2002 |
| EP | 1 304 058 | A1 | 4/2003 |
| EP | 1917883 | A2 | 5/2008 |
| FR | 2 798 267 | A1 | 3/2001 |
| FR | 2991560 | A1 | 12/2013 |
| KR | 20-2009-0006822 | U | 7/2009 |
| WO | 93/016617 | A1 | 9/1993 |
| WO | WO 2013030766 | * | 3/2013 |
| WO | WO 2015140123 | * | 9/2015 |

OTHER PUBLICATIONS

Office Action (OA) for EP 16 716 609.9-1113 dated Nov. 15, 2021 (6 pages).

* cited by examiner

BRUSH FOR APPLYING A PRODUCT TO THE EYELASHES AND/OR EYEBROWS

The present invention relates to brushes for applying a cosmetic product to the eyelashes or eyebrows, notably a makeup or care product, for example mascara, and to packaging and application devices comprising such a brush.

A large number of applicators, in which the brush comprises a core formed by two arms of a metal wire that are twisted together and grip bristles, are known. Since the bristles used are generally the same length, once the arms are twisted, the brush has an envelope surface in the form of a cylinder of revolution. Such a cylinder of revolution form has limited effectiveness in terms of loading the eyelashes with product and separation.

Efforts have thus been made to give the envelope surface more complex shapes so as to form on the brush, after wiping, zones that are more heavily laden with product, making it possible to properly load the eyelashes, and zones that are less heavily laden or are laden little, these being usable to separate the eyelashes. Finding the form that results in the optimum makeup result requires numerous tests, since many factors come into play.

In addition, it is economically advantageous for the brush to be able to be manufactured quickly and easily.

Furthermore, the core of the brush can be rectilinear or curved.

The applications EP 0 832 580 and EP 0 842 620 relate to mascara brushes, the twisted core of which is fully curved along its entire length.

In the applications US 2009/0199862, EP 1 236 419, EP 1 236 420 and EP 1 236 421, the core of the brush can, in some cases, be slightly curved, the curvature extending along more than half the length of the core.

The same goes for the brush in FR 2 798 267, in which the brush is curved so as to allow the ends thereof to come into contact with the internal surface of the container.

The applications EP 1 304 058 and KR 20-2009-0006822 relate to mascara brushes that are curved so as to reproduce the shape of the row of eyelashes along virtually the entire length thereof.

Finally, the applications US 2010/0003065, WO93/16617 and EP 1 236 421 relate to mascara brushes that are curved but do not have a cutout.

There is a need to improve the hand movements for applying makeup and to make application easier along the entire row of eyelashes, in particular at the corner of the eye.

There is also a need to improve brushes, notably to benefit from brushes that are capable of satisfactorily making up the eyelashes and eyebrows, by providing a sufficient load of product and satisfactory combing.

The invention aims to meet all or some of these needs and therefore the subject thereof, according to one of its aspects, is a brush for applying a product to the eyelashes and/or eyebrows, comprising:

a core, notably a twisted core, extending along a longitudinal axis X, comprising a portion of the core carrying the bristles that has a proximal end intended to be fixed to a stem and a distal end, the portion of the core carrying the bristles having a rectilinear proximal portion that extends along more than half of the length of the portion of the core carrying the bristles from the proximal end of the portion of the core carrying the bristles, and having at least one bend made at the distal end of the portion of the core carrying the bristles, and bristles held by the core, the bristles having free ends that define an envelope surface S, the envelope surface S having at least one longitudinally extending cutout.

The expression "at the distal end" means that the bend is made at a point on the portion of the core carrying the bristles that is closer to its distal end than to its proximal end. In other words, the bend is made at a point on the portion of the core carrying the bristles that is situated at less than ½ L from the distal end of the portion of the core carrying the bristles and at more than ½ L from the proximal end of the portion of the core carrying the bristles, where L is the length of the portion of the core carrying the bristles measured between its proximal end and its distal end. In absolute terms, the length L can be between 15 mm and 45 mm, better still between 20 mm and 40 mm, or even between 25 mm and 35 mm.

The brush according to the invention can make it easier to make up the eye, in particular the corner of the eye, and even more particularly the inside corner of the eye. The distal portion of the brush, situated after the bend in the core, is preferably reserved for this use.

With the brush according to the invention, it is also possible to apply make up by placing the brush head-on with respect to the face rather than across the latter, it being possible in this way to produce new makeup effects and to reach eyelashes that are otherwise difficult to make up with precision, while maintaining good visibility of the eyelashes during the operation. It also makes it easier to make up the eyelashes by holding the brush in a plane substantially perpendicular to the face.

Such a bent shape of the core can allow the user to apply their makeup while keeping their elbow close to their body. Making up the eye is thus less difficult than with a brush with a rectilinear core.

Finally, the brush according to the invention can provide sufficient wiping with a conventional wiping member.

The bend may be made at a point on the core that is situated at less than ⅓ L from the distal end of the portion of the core carrying the bristles and at more than ⅔ L from the proximal end of the portion of the core carrying the bristles. The bend may be made at a point on the core that is situated at less than ¼ L from the distal end of the portion of the core carrying the bristles and at more than ¾ L from the proximal end of the portion of the core carrying the bristles.

The core may comprise a rectilinear distal portion made between the bend and the distal end of the portion of the core carrying the bristles. The rectilinear distal portion may extend along a length $L_d$ of between 1/12 L and ½ L, better still between ⅙ L and ⅓ L, or even ⅕ L and ¼ L. In absolute terms, the length $L_d$ can be between 1 mm and 12 mm, better still between 2 mm and 10 mm, or even between 3 mm and 7 mm.

The rectilinear proximal portion, made between the bend and the proximal end of the portion of the core carrying the bristles, may extend along a length $L_p$ of between ½ L and 11/12 L, better still between ⅔ L and ⅚ L, or between ¾ L and ⅘ L. In absolute terms, the length $L_p$ can be between 10 mm and 30 mm, better still between 12 mm and 25 mm, or even between 15 mm and 20 mm.

The proximal rectilinear portion and distal rectilinear portion of the portion of the core carrying the bristles may form an angle γ of between 10° and 60°, better still between 15° and 50°, for example between 20° and 30°, between one another.

The bend may have a radius of curvature of between 5 and 25°.

The bend may be made in a plane P containing the longitudinal axis X of the core, the envelope surface comprising a cutout, the axis of which extends in said plane P. The expression "made in the plane P" means that the proximal and distal rectilinear portions of the portion of the core carrying the bristles extend in the plane P and that the cutout extends generally along this plane P.

The brush is fixed preferably by its proximal end to a stem.

Preferably, the core is a twisted core. The expression "twisted core" should be understood as meaning a core formed by twisting two arms of a metal wire together in a conventional manner.

The longitudinal axis X is preferably rectilinear, apart from the abovementioned bend.

The brush may be chamfered at its proximal and/or distal ends.

Cutout

By virtue of the cutout(s), the brush according to the invention is notably able to store product along the majority of its length so as to provide a sufficient load of product to the eyelashes and/or eyebrows.

The cutout may have the following features, separately or in combination:

- a length $L_2$ where $L_2 > L/2$, where L is the length of the portion of the core carrying the bristles,
- a width w, measured at the bottom of the cutout, that is constant along at least a portion of its length $L_2$, and
- a distance d from the longitudinal axis that varies along its length.

The constant width of the bottom of the cutout along a portion of its length makes manufacturing easier, since the cutout can be hollowed out by a cutting tool moving along the longitudinal axis of the core, rotating on itself about a rotation axis perpendicular to the longitudinal axis of the core.

It is possible to have a cutout that is bordered by relatively stiff flanks, if desired, thereby making advantageous crests for separating the eyelashes.

The variable depth of the cutout makes it possible to have more product in a predefined region of the brush, for example around half-way along, and less product elsewhere; it may be advantageous to have less product close to the distal end of the brush, so as to use this region of the brush to properly separate the eyelashes, in particular those at the corner of the eye.

The cutout may be produced by moving a tool for cutting the bristles both along an axis parallel to the longitudinal axis of the core and along an axis perpendicular to the longitudinal axis of the core, the longitudinal movement making it possible to define the length $L_2$ of the cutout and the perpendicular movement making it possible to define the distance d from the longitudinal axis. The cutting tool may have a longitudinal axis perpendicular to the longitudinal axis of the core and parallel to the bottom of the cutout or, in a variant, perpendicular to the bottom of the cutout. Preferably, this cutting tool is rotated about its longitudinal axis. The width of the cutting end of the cutting tool gives the width w of the cutout.

In a variant, such a cutout is produced by moving a cutting tool about a rotation axis perpendicular to the longitudinal axis of the core, notably an axis parallel to the bottom of the cutout. The cutting tool may have a longitudinal axis perpendicular to the bottom of the cutout. Preferably, this cutting tool is rotated about its longitudinal axis.

Preferably, the length $L_2$ of the cutout is such that $L_2 \geq \frac{2}{3}$ L. This makes it possible to have a cutout which extends along a great majority of the length of the core carrying the bristles, thereby making it possible notably to obtain the desired effect on most of the eyelashes with minimum hand movements.

The width w of the cutout may be constant along a portion of length $L_3$ of the cutout greater than or equal to 10% of the length $L_2$ of the cutout, better still greater than or equal to 50% of the length $L_2$ of the cutout, even better still greater than or equal to 75% of the length $L_2$ of the cutout, and even better still along the entire length $L_2$ of the cutout.

The distance d from the longitudinal axis, measured in a longitudinal mid-plane of the cutout, can vary continuously along the length of the cutout. The distance d from the longitudinal axis can change along a curve that does not have any angular points. This can make it possible to vary, notably continuously, the quantity of product stored in the brush depending on the position along the longitudinal axis X.

The bottom of the cutout may have, in longitudinal section, a profile that is concave towards the outside, notably having a radius of curvature r towards the outside of between 20 mm and 80 mm, better still between 40 mm and 65 mm.

The cutout may have, in cross section, a flat bottom or a bottom that is convex towards the outside. When the bottom is convex towards the outside, the bottom may form, in cross section, a circular arc having a radius approximately equal to the distance d from the longitudinal axis.

The shape of the bottom of the cutout is defined entirely by the cutting tool. When the bottom is flat in cross section, the longitudinal axis of the cutting tool is, preferably, perpendicular to the bottom of the cutout or to the width of the bottom of the cutout. When the bottom of the cutout is convex towards the outside in cross section, the longitudinal axis of the cutting tool is, preferably, parallel to the bottom of the cutout and the surface of the cutting tool forming the bottom of the cutout has a concave profile towards the outside in the widthwise direction of the bottom of the cutout.

The flanks of the cutout preferably diverge towards the outside. The flanks of the cutout may form an angle $\alpha$ of between 20° and 60°, better still between 30° and 50°, even better still between 35° and 45°, between one another. The shape of the flanks is notably due to the radial orientation of the bristles starting from the core. Specifically, the flanks are formed by the bristles next to the cutout which have not been severed by the cutting tool.

The width w of the cutout may be between 1 mm and 4 mm, better still between 1.5 mm and 3.5 mm.

The ratio w/W may be between 0.9 and 0.4, preferably between 0.8 and 0.7, W being the width of the cutout measured at the surface thereof.

The minimum distance $d_{min}$ from the longitudinal axis may be between 1 mm and 4 mm, better still between 2.5 mm and 3.5 mm.

The ratio $2\,d_{min}/D$ may be between 0.4 and 0.9, better still between 0.6 and 0.9.

The envelope surface preferably has a plurality of cutouts, notably between 3 and 6 cutouts, preferably four cutouts. Preferably, the cutouts are distributed evenly around the core.

The envelope surface, apart from the cutouts, may be cylindrical. Before the formation of the bend in the core, the envelope surface, apart from the cutouts, may be axisymmetric, notably with a circular section, having a diameter D. The ratio w/D may be between 0.4 and 0.1, preferably between 0.3 and 0.2.

The length L of the portion of the core carrying the bristles may be less than or equal to 50 mm, better still less than or equal to 40 mm, measured along the longitudinal axis of the brush. It is between 25 and 35 mm for example.

Device

A further subject of the invention is a packaging and application device comprising:

a container containing the product to be applied, and a brush according to the invention.

The container may be provided with a wiping member for removing the excess product present on the stem and on the brush. This wiping member comprises for example a lip made of an elastomeric material, defining a wiping orifice of circular section, the diameter of which corresponds substantially to that of the stem.

Manufacturing Method

A further subject of the invention is a method for manufacturing a brush according to the invention, comprising the following steps of:

producing a brush blank having a rectilinear core, cutting the bristles so as to form one or more cutouts, and then bending the core.

The envelope surface of the blank, after cutting and before the core has been bent, may have a shape other than a cylinder of revolution.

The cutout(s) can be formed by moving a cutting tool both along an axis parallel to the longitudinal axis of the core and along an axis perpendicular to the longitudinal axis of the core.

In a variant or additionally, the cutout(s) can be formed by moving a cutting tool about an axis perpendicular to the longitudinal axis of the core, notably an axis parallel to the bottom of the cutout.

The cutting tool preferably has a longitudinal axis parallel or perpendicular to the bottom of the cutout, or perpendicular to the width of the cutout.

The cutting tool is preferably rotated about its longitudinal axis.

When the longitudinal axis of the cutting tool is perpendicular to the bottom of the cutout or to the width of the bottom of the cutout, the cutting surface may be formed by a base of the cylinder. In this case, the bottom of the cutout formed is preferably flat in cross section.

When the longitudinal axis of the cutting tool is parallel to the bottom of the cutout, the cutting surface is formed by the lateral surface of the cylinder. In this case, the cross-sectional profile of the bottom of the cutout depends on the profile of the generatrix of the cylinder.

The cutting tool may have a cylindrical shape with a generatrix oriented perpendicularly to the longitudinal axis of the core and perpendicularly to the bottom of the cutout.

The cutting tool preferably has a width substantially equal to the width w of the cutout.

The cutting tool may have a cutting surface with a planar shape or a shape that is concave towards the outside.

DETAILED DESCRIPTION

Figure 3:
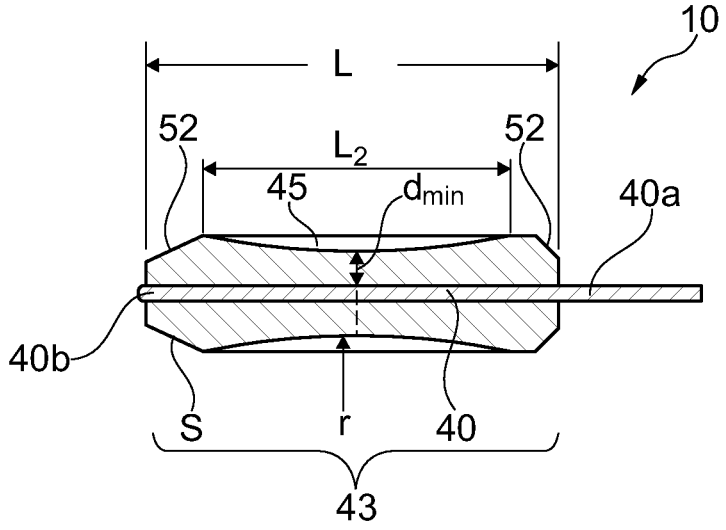
Figure 2A:
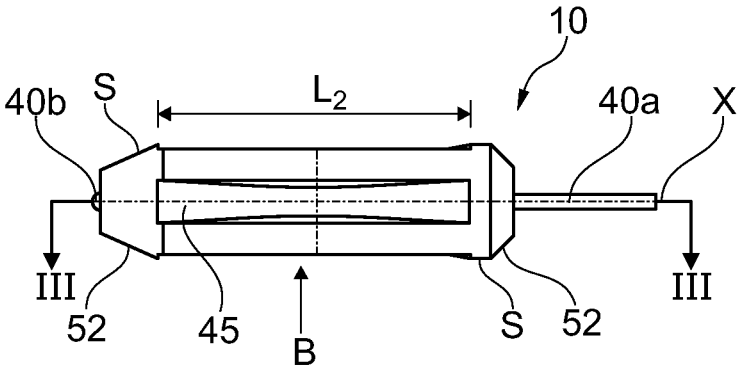
Figure 4:
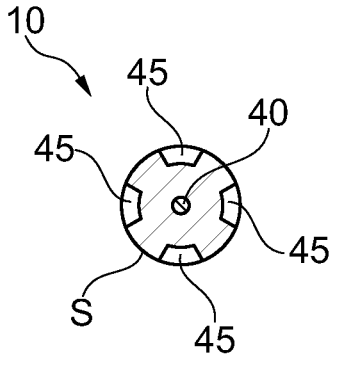
Figure 2B:
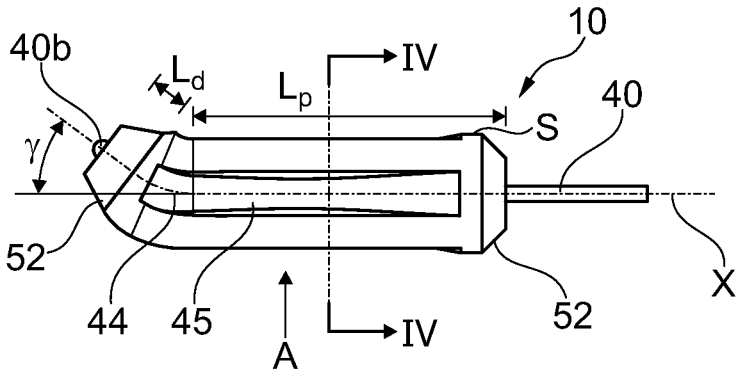
Figure 7A:
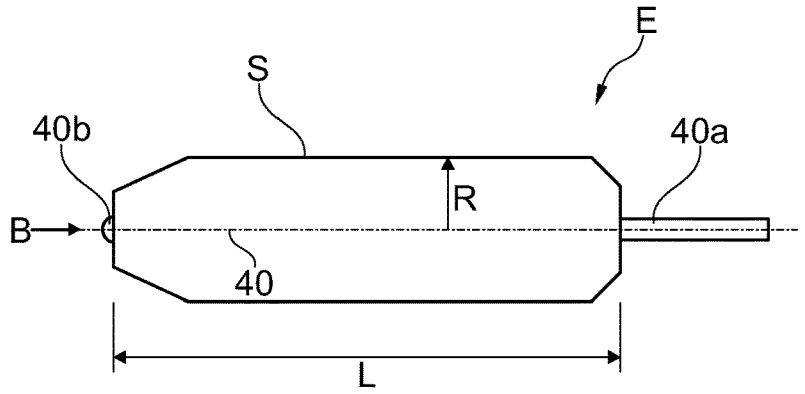
Figure 7B:
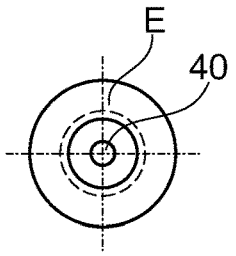
Figure 6A:
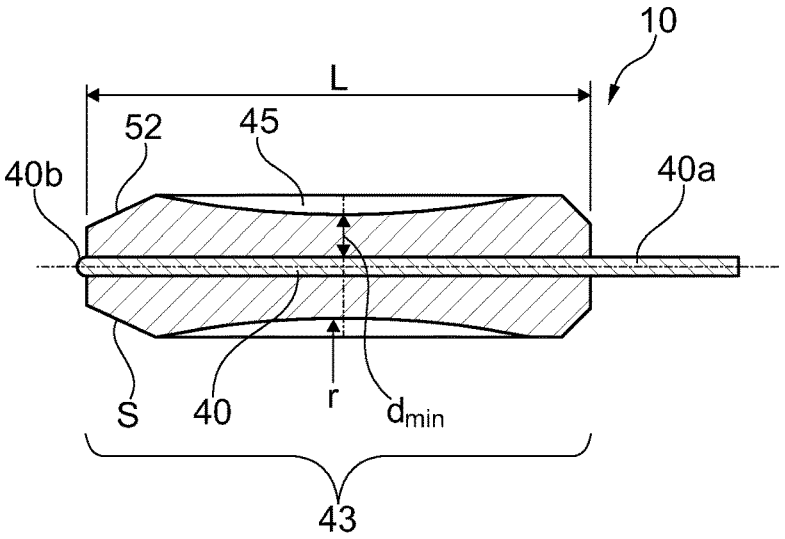
Figure 6B:
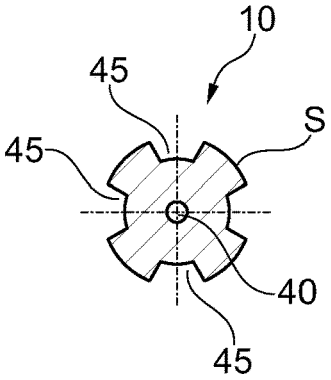
Figure 5:
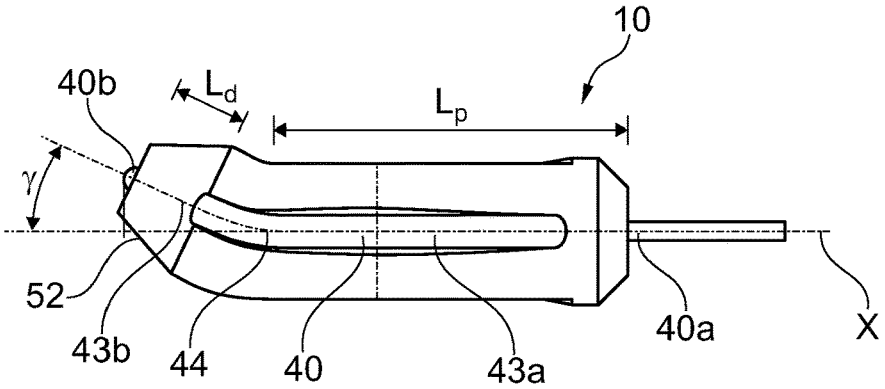
Figure 8B:
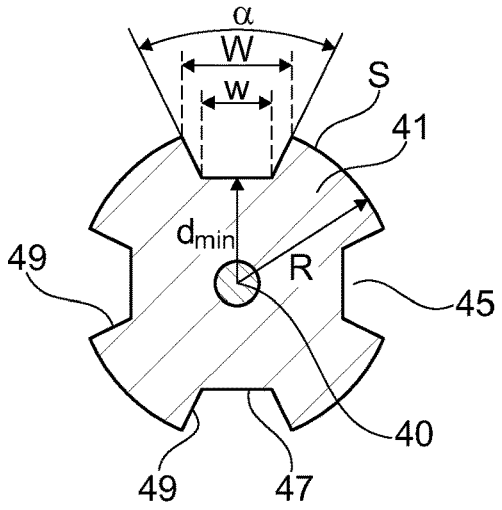
Figure 8A:
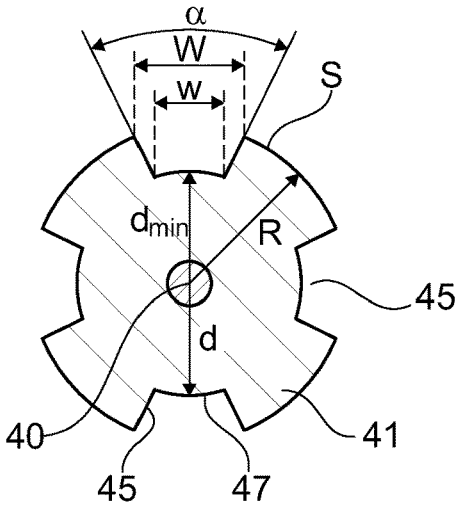
Figure 9A:
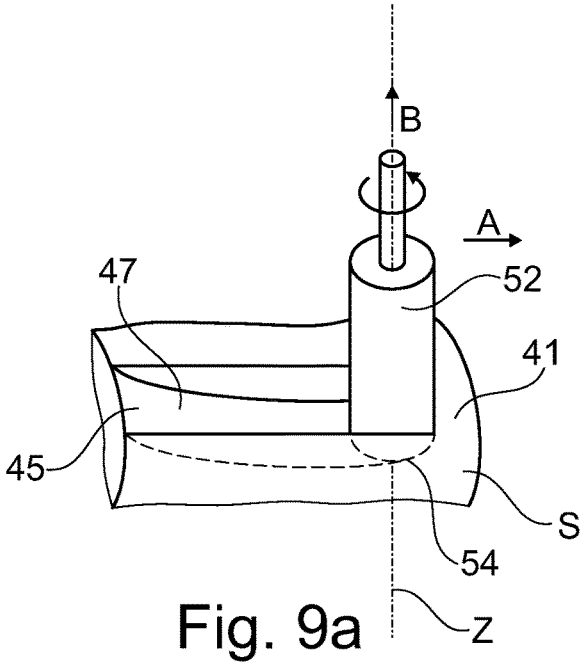
Figure 9C:
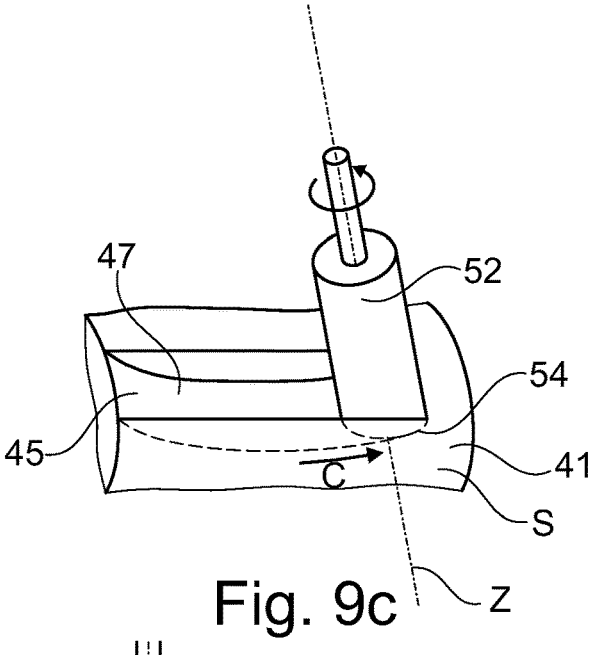
Figure 9B:
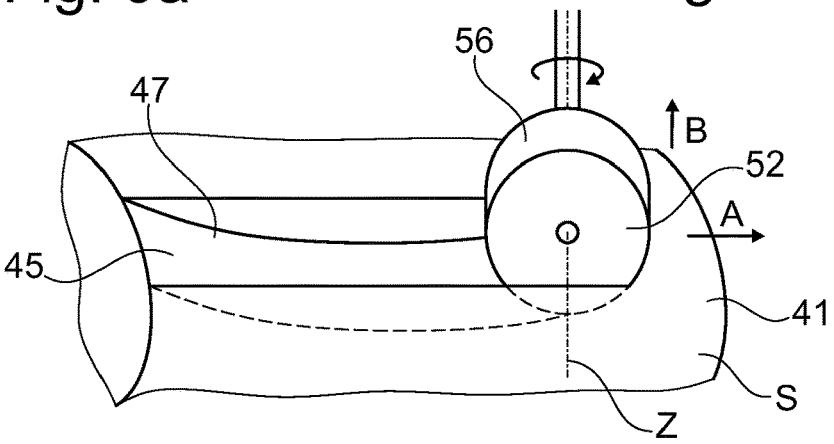
Figure 10A:
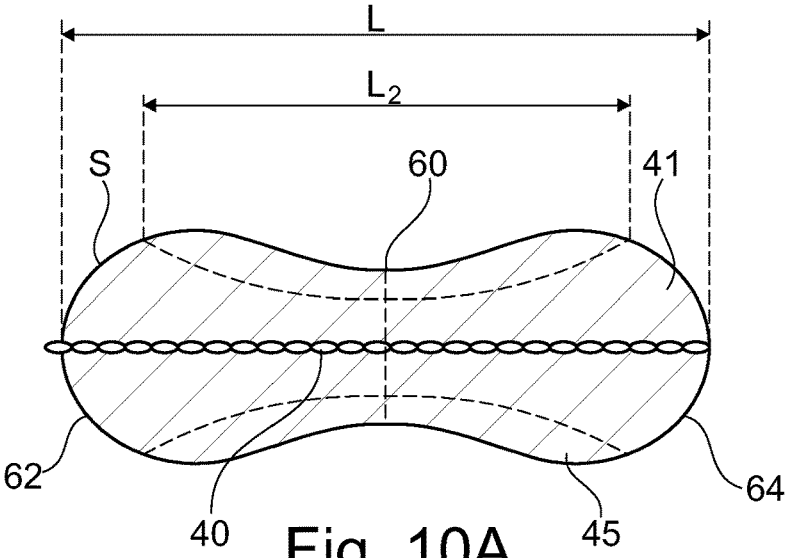
Figure 10B:
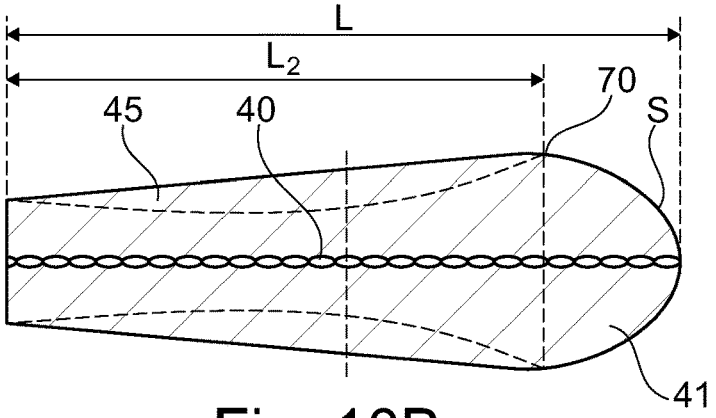
Figure 10C:
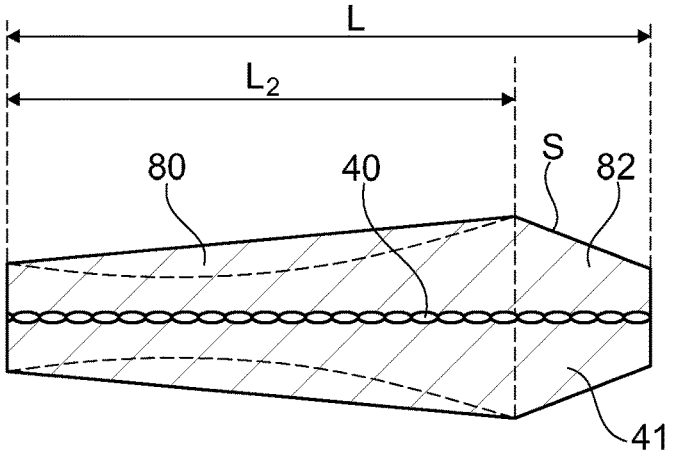
Figure 10D:
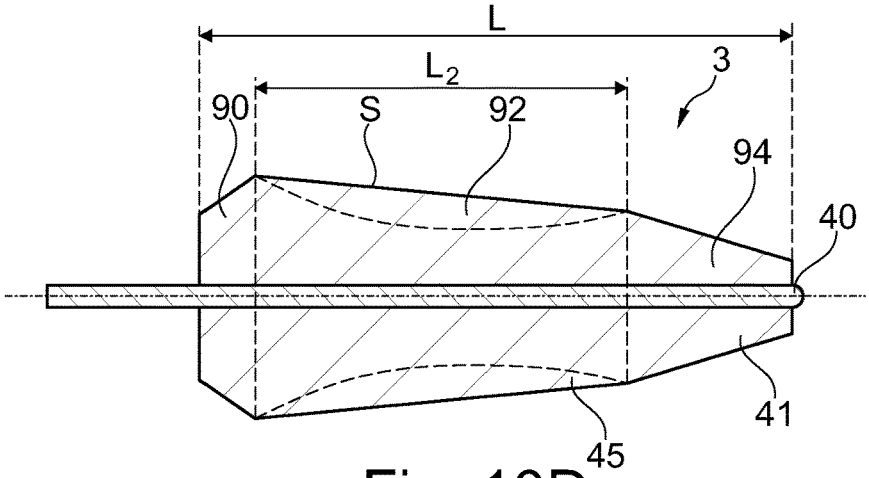
Figure 10E:
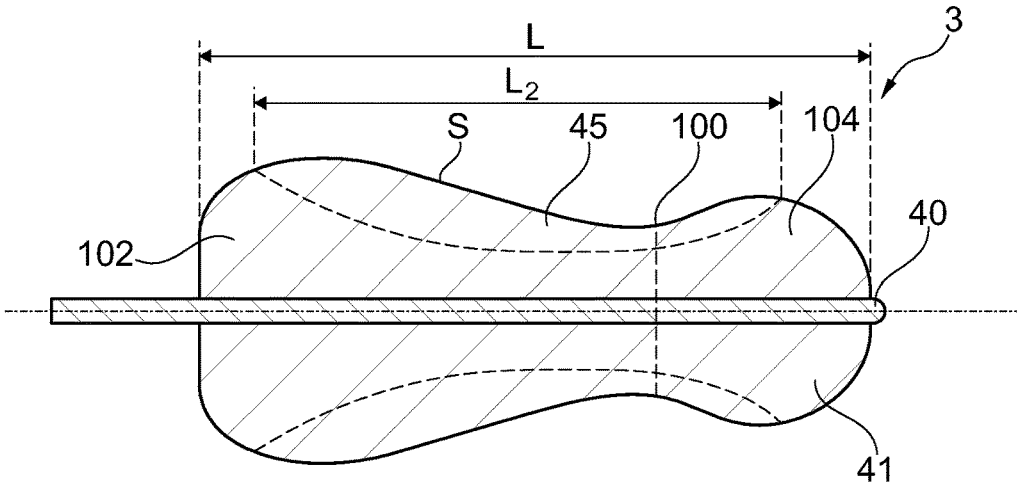
Figure 10F:
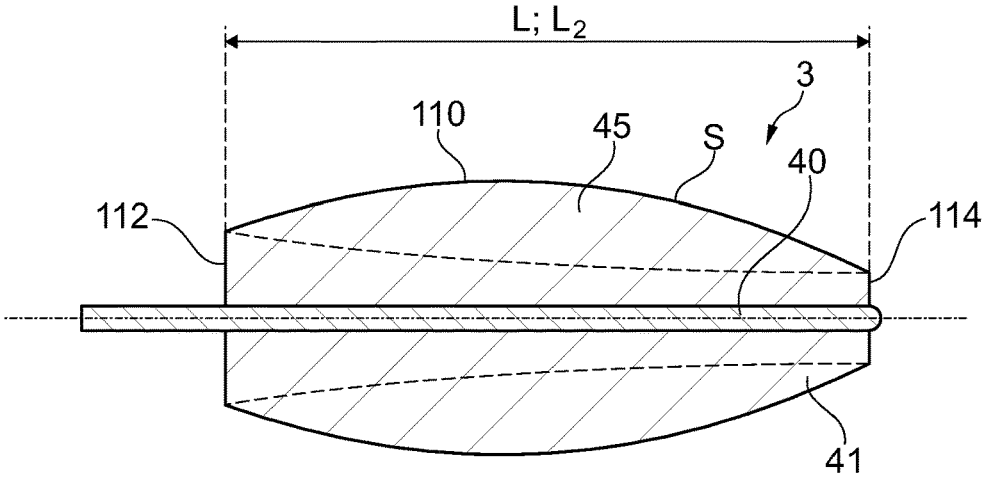
Figure 10G:
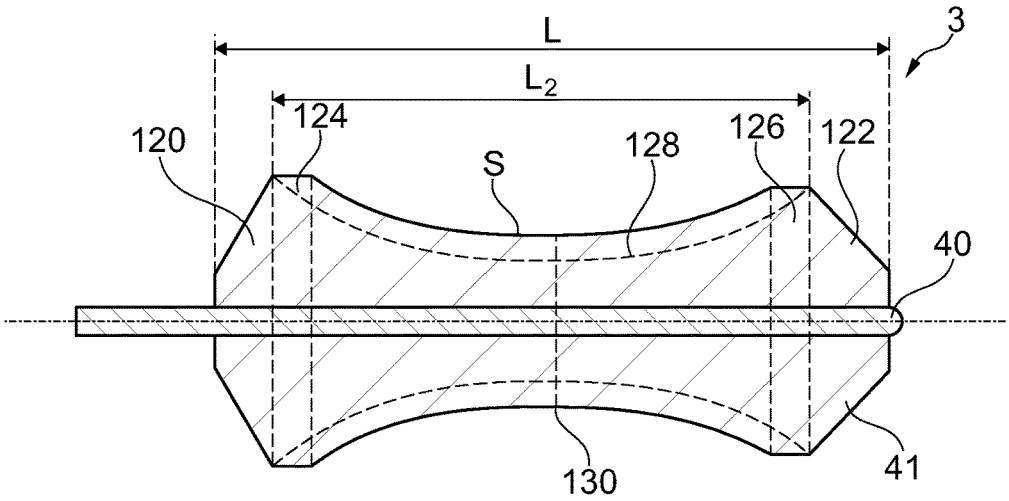
Figure 11:
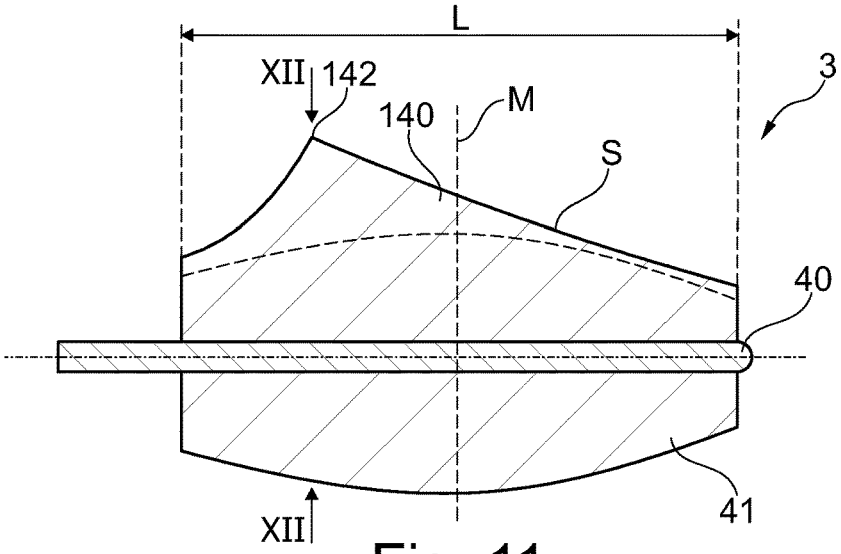
Figure 12:
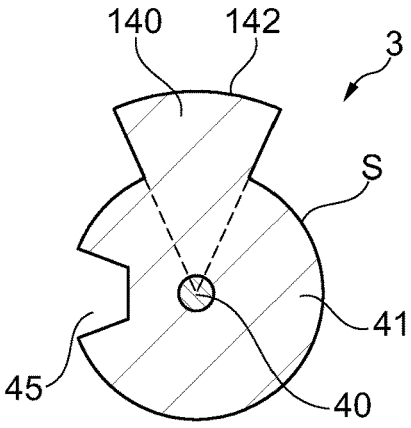
Figure 13:
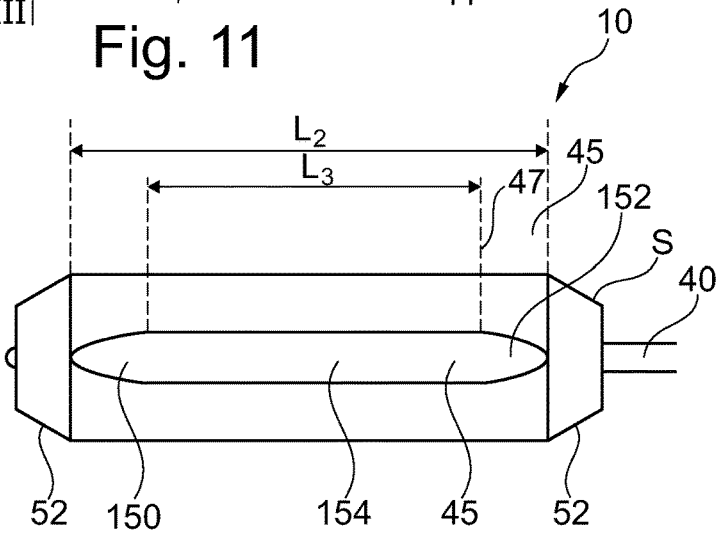

The invention may be better understood from reading the following detailed description of non-limiting illustrative embodiments thereof and from examining the appended drawing, in which:

FIG. 1 shows an example of a packaging and application device according to the invention, in schematic and partial longitudinal section, FIGS. 2*a* and 2*b* are views along the arrows A and B, respectively, of an example of a brush according to the invention, FIG. 3 is a view in longitudinal section on III-III in FIG. 2*a*, FIG. 4 is a cross-sectional view on IV-IV in FIG. 2*b*, FIG. 5 is a view similar to FIG. 2*b* of a variant embodiment, FIG. 6*a* is a view in longitudinal section, similar to FIG. 3, of the brush in FIG. 5, FIG. 6*b* is a cross-sectional view, similar to FIG. 4, of the brush in FIG. 5, FIG. 7*a* is a side view of the blank used to produce the brush in FIG. 5, FIG. 7*b* is a view along the arrow B in FIG. 7*a*, FIGS. 8*a* and 8*b* are enlarged views of FIGS. 4 and 6*b*, respectively, FIG. 9*a* shows an example of a method for manufacturing a brush according to the invention, FIG. 9*b* shows a variant method for manufacturing a brush according to the invention, FIG. 9*c* shows a variant method for manufacturing a brush according to the invention, FIGS. 10A to 10G are views similar to FIG. 3 of variant brushes, FIG. 11 is a longitudinal section through a variant brush according to the invention, FIG. 12 is a view on XII-XII of the brush in FIG. 11, and FIG. 13 is a schematic top view of a variant brush according to the invention.

In the rest of the description, identical elements or elements having identical functions bear the same reference signs. Their description is not repeated for each of the figures, only the main differences between the embodiments being mentioned.

The packaging and application device 1 shown in FIG. 1 comprises a container 2 containing a product P to be applied to the eyelashes or eyebrows and an applicator 3 which may be fixed removably to the container 2 in the example in question. The product P comprises for example one or more pigments, in particular an iron oxide. It is for example a mascara.

The applicator 3 comprises a stem 5 of longitudinal axis Y, which is provided at a distal end 5*a* of the stem 5 with a brush 10 according to the invention, and at the other end with a gripping member 11 that likewise forms a cap for closing the container 2 in a sealed manner. As can be seen notably in FIG. 1, the latter comprises a body 13 which is provided at the top with a threaded neck 14 onto which the gripping member 11 can be screwed in order to close the container 2 in a sealed manner. In a variant, the applicator can be fixed to the container in some other way.

The neck 14 may accommodate, as illustrated, a wiping member 20 which is for example inserted into the neck 14. This wiping member 20 comprises a lip 26 that defines a wiping orifice having a diameter adapted to that of the stem 5.

The brush 10 may be fixed, in a conventional manner, in a housing provided at the distal end 5*a* of the stem 5, which is advantageously made of a thermoplastic material. The brush 10 comprises a twisted metal core 40 comprising a portion 43 of the core carrying the bristles, which is fixed at a proximal end 40*a* in the corresponding housing of the stem 5 by a portion of the core that does not have bristles, it being possible for the latter portion to have a length of around 8 mm.

The portion 43 of the core carrying the bristles also comprises a free end 40*b*.

The core 40 carries bristles 41, the free ends of which define an envelope surface S of the brush 10, as illustrated in FIG. 2. As illustrated in FIG. 4, the bristles 41 extend along a length L of the core of preferably between 25 mm and 35 mm, in this case approximately equal to 30 mm.

The core 40 is formed conventionally by two arms of a metal wire folded in a U-shape, the bristles 41 being held between the turns of the core 40. The diameter of the metal wire is for example between 0.1 and 1 mm. The diameter of the bristles is for example between 0.06 and 0.35 mm.

The portion 43 of the core carrying the bristles has a rectilinear proximal portion 43*a* that extends along more than half of its length from the proximal end 40*a* of the portion of the core carrying the bristles, and also a rectilinear distal portion 43*b*.

The rectilinear distal portion 43*b* extends along a length $L_d$, which is around 5 mm in the example described. The rectilinear proximal portion 43*a* extends along a length $L_p$, which is around 25 mm in the example described.

The core has at least one bend 44 between the proximal portion 43*a* and distal portion 43*b* of the portion of the core carrying the bristles. The bend is made at the distal end of the portion of the core carrying the bristles, that is to say that the bend is made at a point on the portion of the core carrying the bristles that is closer to its distal end 40*b* than to its proximal end 40*a*. In this example, the bend 44 is made at a point on the core that is situated around ⅙ L from the distal end of the portion of the core carrying the bristles and around ⅚ L from the proximal end of the portion of the core carrying the bristles.

The proximal rectilinear portion 43*a* and distal rectilinear portion 43*b* of the portion of the core carrying the bristles can form an angle γ of around 35° between one another. The bend may have a radius of curvature of between 5 and 25°.

In the example described, the bend 44 is made in a plane P containing the longitudinal axis X of the core, the envelope surface comprising a cutout 45, the axis of which extends in said plane P. This plane P is the plane in FIG. 2*b*. The proximal rectilinear portion and distal rectilinear portion of the core extend in the plane P.

As illustrated in FIGS. 2*a*, 2*b*, 3 and 4, the envelope surface S comprises a plurality of cutouts 45, there being four thereof, extending longitudinally along an axis substantially parallel to the longitudinal axis X of the core 40. As can be seen in FIG. 3, the cutouts 45 extend along a length $L_2$ greater than more than ⅔ of the length L of the portion 43 of the core 40 carrying the bristles 41; in this case the length $L_2$ is greater than ¾ of the length L.

In the variant embodiment illustrated in FIGS. 5, 6*a* and 6*b*, the angle γ is slightly smaller, being around 25°, and the shape of the cutouts is different, as will be described in detail with reference to FIGS. 8*a* and 8*b*.

The blank E used to obtain the brush in FIGS. 5, 6*a* and 6*b* is also illustrated in FIGS. 7*a* and 7*b*. The envelope surface S of the blank has substantially the shape of a cylinder of revolution. The maximum radius R of the envelope surface S, corresponding to the radius of the smallest cylinder of revolution in which the blank is inscribed, is between 3 mm and 6 mm, in this case substantially equal to 4.2 mm.

The cutouts 45 will now be described in more detail.

The cutouts 45 are at a distance d from the longitudinal axis X, said distance being variable along their length $L_2$, notably a continuously variable distance d. In longitudinal section, as illustrated in FIG. 3, the cutouts 45 have a profile that is concave towards the outside, notably in a circular arc. The radius of curvature r of the profile of the cutouts 45 is preferably between 40 mm and 65 mm, for example around 50 mm.

The minimum distance $d_{min}$ from the longitudinal axis X is preferably between 2.5 and 3.5 mm, for example substantially equal to 3 mm. The ratio $d_{min}/R$ is preferably between 0.4 and 0.9, better still between 0.6 and 0.9, better still substantially equal to 0.7.

In the example illustrated in FIGS. 1 to 4, the envelope surface S comprises four identical cutouts 45 that are distributed evenly around the core 40. The cutouts 45 have a bottom 47 that is convex towards the outside. In cross section, the bottom 47 of the cutouts 45 can form a circular arc with a radius substantially equal to d.

As can be seen in FIG. 8*a*, the width w of the cutouts 45, measured at the bottom 47 of the cutouts 45, is constant along the entire length $L_2$ of the cutouts 45. The width w of the cutouts 45 is preferably between 1 mm and 4 mm, better still between 1.5 mm and 3.5 mm, in this case substantially equal to 2.3 mm.

The cutouts 45 have flanks 49 that diverge towards the outside and form an angle α of between 35° and 45°, in this case substantially equal to 40°, between one another. The width W of the cutouts 45, measured at their surface, is thus greater than the width w at the bottom of the cutouts 45. The ratio of the widths w/W is preferably between 0.8 and 0.7.

As illustrated in FIGS. 2*a*, 2*b* and 3, the ends 52 of the envelope surface S are chamfered. This can make it easier for the brush 3 to pass through the wiping member 20. The chamfer at the distal end and the chamfer at the proximal end are in this case different. The angle of the chamfer at the distal end is notably less inclined than that at the proximal end.

The example illustrated in FIG. 8*b* differs from that illustrated in FIG. 8*a* in that the shape of the bottom 47 of the cutouts 45 is flat.

The cutouts 45 can be produced using a cutting tool 52, illustrated in FIGS. 9*a* to 9*c*. The cutting tool 52 is preferably in the form of a cylinder, notably a cylinder of revolution. The cutting tool 52 comprises a cutting surface that comes into contact with the bristles 41 and cuts the bristles 41 so as to form a cutout 45. The width of the cutting surface of the cutting tool 52 defines the width w of the cutout 45. The cutting tool 52 comprises a longitudinal axis Z and is rotated about said longitudinal axis Z. This makes it easier to cut the bristles.

In the example illustrated in FIG. 9*a*, the bristles 41 are cut by moving the cutting tool 52 both in a direction A parallel to the longitudinal axis X and in a direction B perpendicular to the longitudinal axis X. The longitudinal axis Z is perpendicular to the width w of the bottom 47 of the cutout 45. The cutting surface is formed by the free base 54 of the cylinder forming the cutting tool 52. Such a cutting tool 52 makes it possible to obtain a cutout 45 having a flat bottom 47 in cross section.

In the example illustrated in FIG. 9*b*, the bristles 41 are cut by moving the cutting tool 52 both in a direction A parallel to the longitudinal axis X and in a direction B perpendicular to the longitudinal axis X. The longitudinal axis Z is parallel to the bottom 47 of the cutout 45. The cutting surface is formed by the lateral surface 56 of the cylinder forming the cutting tool 52. The shape of the generatrix of the cylinder makes it possible, in this case, to define a particular shape for the bottom 47 of the cutout 45. For example, if the generatrix is a straight line, the bottom 47 will be flat in cross section, and if the generatrix is concave towards the outside, the bottom 47 will be convex towards the outside in cross section.

In the example illustrated in FIG. 9*c*, the bristles 41 are cut by moving the cutting tool 52 about an axis perpendicular to the longitudinal axis X of the core and parallel to the bottom 47 of the cutout 45 in a direction C. The longitudinal axis Z is perpendicular to the bottom 47 of the cutout 45. The cutting surface is formed by the free base 54 of the cylinder forming the cutting tool 52. Such a cutting tool 52 makes it possible to obtain a cutout 45 having a flat bottom 47 in cross section.

The examples in FIGS. 10A to 10G differ from those illustrated in FIGS. 2*a* to 6*b* by way of the shape of the envelope surface S before the core is bent.

FIGS. 10A to 10G have axisymmetric shapes.

In the example illustrated in FIG. 10A, the envelope surface S, apart from the cutouts, is peanut-shaped. It has a diameter that passes through a minimum 60 between two bulging portions 62 and 64, one 62 being proximal and the other 64 distal. The envelope surface S is symmetric with respect to the transverse plane of the minimum diameter. The cutouts 45 are made, for example, from one bulging portion 62 to the other 64, as illustrated.

In the example illustrated in FIG. 10B, the envelope surface S, apart from the cutouts, is bomb-shaped. It has a diameter that passes through a maximum 70 close to the distal end at a circle of greatest diameter. The body of the brush 3 is frustoconical, being connected at its base that is coincident with the circle of greatest diameter to the distal end part of the brush 3, of ogival shape. The cutouts 45 extend, for example, from the proximal end to the part of greatest diameter.

In the example illustrated in FIG. 10C, the envelope surface S, apart from the cutouts, is buoy-shaped. The envelope surface S is defined by two frustoconical portions 80 and 82 that are joined together by their base of greatest diameter. The cutouts 45 extend, for example, from the proximal end to the joint between the two frustoconical portions 60 and 62.

In the example illustrated in FIG. 10D, the envelope surface S, apart from the cutouts, is defined by 3 frustoconical portions 90, 92 and 94 that are joined together by their bases. The frustoconical portion 90 is situated at the proximal end and the portion 94 is situated at the distal end. The portion 92 extends between the two end portions 90 and 94 and is attached to the proximal portion 90 by its base of greatest diameter and to the distal portion 94 by its base of smallest diameter. The cutouts 45 extend, for example, only along the central portion 92.

In the example illustrated in FIG. 10E, the envelope surface S, apart from the cutouts, is in the form of an asymmetric peanut. It has a diameter that passes through a minimum 100 between two bulging portions 102 and 104, one 102 being proximal and the other 104 distal. The minimum 100 is closer to the distal end than to the proximal end. The bulging portions 102 and 104 have different greatest diameters, notably the greatest diameter of the portion 104 is smaller than the greatest diameter of the portion 102. The cutouts 45 are made, for example, from one bulging portion 102 to the other 104, as illustrated.

In the example illustrated in FIG. 10F, the envelope surface S, apart from the cutouts, also has a bulging shape. It has a diameter that passes through a maximum 110. This maximum 110 is situated substantially at the centre of the portion of the core carrying the bristles. The distal end 114 and the proximal end 112 have different diameters; notably the diameter of the distal end 114 is smaller than that of the proximal end 112. The cutouts 45 extend, for example, from the distal end 114 to the proximal end 112.

In the example illustrated in FIG. 10G, the envelope surface S, apart from the cutouts, has the overall shape of a diabolo with two frustoconical end portions 120 and 112 that are connected by their bases of greatest diameter to two cylindrical portions 124 and 126, respectively, which are themselves connected together by a portion 128 that narrows towards the centre. This portion 128 has a minimum diameter 130 substantially at the centre of the part of the core carrying the bristles. The cylindrical portions 124 and 126 have the same thickness and different diameters. The distal cylindrical portion 126 has a smaller diameter than the proximal cylindrical portion 124. The frustoconical portions 120 and 122 have the same thickness. The cutouts 45 are made, for example, from one cylindrical portion 124 to the other 126, as illustrated.

The example in FIGS. 11 and 12 differs from that in FIGS. 2*a* to 6*b* in that the envelope surface S is not axisymmetric and in that it has only one cutout 45.

The envelope surface S may have an angular sector 140 defined by bristles that are longer than the rest of the brush 3. The angular sector 140 extends along the entire length L of the brush 3 and may have, in longitudinal section, a profile with a variable height with respect to the longitudinal axis X, notably a profile in the form of a dorsal fin. Within the angular sector 140, the height of the envelope surface S can pass through a maximum 142 close to the proximal end. The rest of the envelope surface S, apart from the cutout 45, can have a symmetric bulging shape with respect to a mid-plane M. The cutout 45 can extend along the envelope surface S from the proximal end to the distal end, somewhere other than the angular sector.

In a variant, the cutout 45 can extend along the angular sector 140 from the proximal end to the distal end.

The example in FIG. 13 differs from that in FIGS. 2*a* to 6*b* in that the cutouts 45 have a width w that is variable in two portions 150 and 152 and constant in a portion 154 extending between the portions 150 and 152. The portion 154 has a length $L_3$ that makes up more than 50% of the length $L_2$ of the cutout 45.

Generally, the envelope surface can comprise a different number of cutouts and it is possible for the latter not to be identical to one another and/or distributed evenly around the core 40.

The profile of the cutouts in longitudinal section may have angular points, and notably be formed by joined-together segments.

The invention is not limited to the exemplary embodiments which have just been described, the characteristics of which may be combined with one another as parts of variants which are not illustrated.

For example, the cutouts of the examples in FIGS. 10A to 12 can have a concave bottom as illustrated in FIG. 8*a*.

The expression "comprising a" should be understood as being synonymous with "comprising at least".

The invention claimed is:

1. A brush configured for applying a product to the eyelashes and/or eyebrows, comprising:

a core extending along a longitudinal axis of the brush, comprising a portion of the core carrying bristles that have a proximal end intended to be fixed to a stem and a distal end, the portion of the core carrying the bristles having a rectilinear proximal portion that extends along more than or equal to ⅔ of the length of the portion of the core carrying the bristles from the proximal end of the portion of the core carrying the bristles, and having at least one bend made at the distal end of the portion of the core carrying the bristles, and bristles held by the core, the bristles having free ends that define an envelope surface, the envelope surface having at least one cutout, wherein the cutout has a longitudinal axis that is parallel to the longitudinal axis of the brush, wherein the proximal rectilinear portion and a distal rectilinear portion of the core form an angle of between 20° and 30°, between one another, wherein the cutout has, in cross section, a flat bottom or a bottom that is convex towards in a direction towards an outside of the brush;

wherein the cutout has a width w, measured at a bottom of the cutout, that is constant along at least a portion of its length; and wherein the cutout comprises connected sidewalls and a bottom wall, each wall being formed by the bristles.

2. The brush according to claim 1, wherein the portion of the core carrying the bristles comprises a rectilinear distal portion made between the bend and the distal end of the core.

3. The brush according to claim 1, wherein the rectilinear proximal portion, made between the bend and the proximal end of the portion of the core carrying the bristles, extends along a length $L_p$, of between ⅔ L and 11/12 L, where L denotes the length of the portion of the core carrying the bristles.

4. The brush according to claim 1, wherein the bend is made in a plane containing the longitudinal axis of the core, the envelope surface comprising a cutout, the axis of which extends in said plane.

5. The brush according to claim 1, wherein the cutout has, in cross section, a flat bottom or a bottom that is convex towards in a direction towards an outside of the brush.

6. The brush according to claim 1, wherein the bottom of the cutout has, in longitudinal section, a profile that is concave towards in a direction towards an outside of the brush.

7. The brush according to claim 1, wherein the envelope surface S has a plurality of cutouts.

8. The brush according to claim 7, wherein the cutouts are distributed evenly around the core.

9. The brush according to claim 1, wherein the brush is chamfered at its distal and proximal ends.

10. The brush according to claim 1, wherein the core is fixed by its proximal end to a stem.

11. A packaging and application device comprising a container containing a product to be applied and a brush according to claim 1.

12. The brush according to claim 1, wherein the cutout has a length $L_2$, where $L_2 \geq L/2$, where L is the length of the portion of the brush carrying the bristles.

13. The brush according to claim 1, wherein the cutout has a width w, measured at a bottom of the cutout, that is constant along at least a portion of its length.

14. The brush according to claim 1, wherein the cutout has a width, measured at a bottom of the cutout, that is between 1 mm and 4 mm.

15. The brush according to claim 1, wherein a bottom of the cutout is spaced apart from the core.

16. The brush according to claim 1, wherein the cutout is at a distance from the longitudinal axis of the core, said distance being variable along the length of the cutout.

17. The brush according to claim 1, wherein the cutout comprises connected sidewalls and a bottom wall, each wall being formed by the bristles.

18. A method for manufacturing a brush according to claim 1, comprising the following steps of:

producing a brush blank having a rectilinear core, cutting the bristles so as to form one or more cutouts, and then bending the core.

19. The method according to claim 18, wherein the envelope surface of the blank, after cutting and before the core has been bent, has a shape other than a cylinder of revolution.

20. A brush configured for applying a product to the eyelashes and/or eyebrows, comprising:

a core extending along a longitudinal axis of the brush, comprising a portion of the core carrying bristles that have a proximal end intended to be fixed to a stem and a distal end, the portion of the core carrying the bristles having a rectilinear proximal portion that extends along more than or equal to ⅔ of the length of the portion of the core carrying the bristles from the proximal end of the portion of the core carrying the bristles, and having at least one bend made at the distal end of the portion of the core carrying the bristles, and bristles held by the core, the bristles having free ends that define an envelope surface, the envelope surface having at least one cutout, wherein the cutout has a longitudinal axis that is parallel to the longitudinal axis of the brush and wherein the cutout is bordered by stiff flanks.

21. A method for applying a product to the eyelashes and/or eyebrows, the method comprising placing a brush of claim 1 or claim 20 head-on with respect to a face and applying the product on the eyebrows and/or eyelashes.

* * * * *